US006085705A

United States Patent [19]

Vorih

[11] Patent Number: 6,085,705

[45] Date of Patent: Jul. 11, 2000

[54] VARIABLE LOST MOTION VALVE ACTUATOR AND METHOD

[75] Inventor: Joseph M. Vorih, Suffield, Conn.

[73] Assignee: Diesel Engine Retarders, Inc., Wilmington, Del.

[21] Appl. No.: 09/209,486

[22] Filed: Dec. 11, 1998

Related U.S. Application Data

[60] Provisional application No. 60/069,270, Dec. 11, 1997.

[51] Int. Cl.[7] ..... F01L 9/02

[52] U.S. Cl. ..... 123/90.12; 123/90.16; 123/90.22; 123/90.39; 123/321

[58] Field of Search ..... 123/90.11, 90.12, 123/90.13, 90.15, 90.16, 90.22, 90.39, 90.4, 90.41, 90.44, 320, 321, 322, 323, 586.14

[56] References Cited

U.S. PATENT DOCUMENTS

| | | | |
|---|---|---|---|
| 4,768,467 | 9/1988 | Yamada et al. | 123/90.16 |
| 4,913,104 | 4/1990 | Mills | 123/90.4 |
| 4,924,821 | 5/1990 | Teerman | 123/90.22 |
| 5,501,186 | 3/1996 | Hara et al. | 123/90.16 |
| 5,622,146 | 4/1997 | Speil | 123/90.22 |
| 5,626,110 | 5/1997 | Regueiro | 123/90.22 |
| 5,699,762 | 12/1997 | Horiuchi | 123/90.22 |
| 5,829,397 | 11/1998 | Vorih et al. | 123/90.12 |

*Primary Examiner*—Wellun Lo
*Attorney, Agent, or Firm*—David R. Yohannan; Collier Shannon Scott, PLLC

[57] ABSTRACT

A lost motion engine valve actuation system and method of actuating an engine valve are disclosed. The system may comprise a valve train element, pivoting bridge, an adjustable tappet, and a valve stem. The pivoting bridge may include a first end for contacting the adjustable tappet, a second end for contacting the valve stem and a pivot point between the first and second ends for contacting the valve train element. The amount of lost motion provided by the system may be selected by varying the position of the adjustable tappet relative to the pivoting bridge. Variation of the adjustable tappet position may be carried out by placing the adjustable tappet in hydraulic communication with a control trigger valve. Actuation of the trigger valve releases hydraulic fluid allowing for adjustment of the adjustable tappet position.

21 Claims, 3 Drawing Sheets

VARIABLE LOST MOTION VALVE ACTUATOR AND METHOD

CROSS REFERENCE TO RELATED PATENT APPLICATION

This application relates to and claims priority on provisional application Ser. No. 60/069,270, filed Dec. 11, 1997.

FIELD OF THE INVENTION

The present invention relates generally to intake and exhaust valve actuation in internal combustion engines.

BACKGROUND OF THE INVENTION

Valve actuation in an internal combustion engine is required in order for the engine to produce positive power, as well as to produce engine braking. During positive power, intake valves may be opened to admit fuel and air into a cylinder for combustion. The exhaust valves may be opened to allow combustion gas to escape from the cylinder.

During engine braking, the exhaust valves may be selectively opened to convert, at least temporarily, an internal combustion engine of compression-ignition type into an air compressor. In doing so, the engine develops retarding horsepower to help slow the vehicle down. This can provide the operator increased control over the vehicle and substantially reduce wear on the service brakes of the vehicle. A properly designed and adjusted compression release-type engine brake can develop retarding horsepower that is a substantial portion of the operating horsepower developed by the engine in positive power.

The braking power of a compression release-type engine brake may be increased by selectively opening the exhaust valves to carry out exhaust gas recirculation (EGR) in combination with compression release braking. Exhaust gas recirculation denotes the process of briefly opening the exhaust valve near bottom dead center on the intake stroke of the piston. Opening of the exhaust valve at this time permits higher pressure exhaust gas from the exhaust manifold to recirculate back into the cylinder. The recirculation of exhaust gas increases the total gas mass in the cylinder at time of the subsequent compression release event, thereby increasing the braking effect realized by the compression release event.

For both positive power and engine braking applications, the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift needed to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a fill range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in co-pending U.S. application Ser. No. 08/701,451 filed Aug. 22, 1996, Ser. No. 08/512,528 filed Aug. 8, 1995 (now abandoned), and in Hu U.S. Pat. No. 5,537,976, which are assigned to the same assignee as the present application, and which are incorporated herein by reference.

In the lost motion system of Applicant's co-pending application, an engine cam shaft may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Many lost motion systems have not had the combined capability of providing an adequate fail-safe or "limp home" mode of operation and of providing variable degrees of valve lift over an entire range of cam lobe positions. In previous lost motion systems, a leaky hydraulic circuit could disable the master piston's ability to open its associated valve(s). If a large enough number of valves cannot be opened at all, the engine cannot be operated. Therefore, it is important to provide a lost motion system which enables the engine to operate at some minimum level (i.e. at a limp home level) should the hydraulic circuit of such a system develop a leak. A limp home mode of operation may be provided by using a lost motion system which still transmits a portion of the cam motion to the valve after the hydraulic circuit therefor leaks or the control thereof is lost. In this manner the most extreme portions of a cam profile can still be used to get some valve actuation after control over the variable length of the lost motion system is lost and the system has contracted to a minimum length. The foregoing assumes, of course, that the lost motion system is constructed such that it will assume a fully contracted position should control over it be lost and that the valve train will provide the minimum valve actuation necessary to operate the engine when the system is fully contracted. In this manner the lost motion system may be designed to allow the engine to operate, albeit not optimally, so that an operator can still "limp home" and make repairs.

Kruger, U.S. Pat. No. 5,451,029 (Sep. 19, 1995), for a Variable Valve Control Arrangement, assigned to Volkswagen AG, discloses a lost motion system which when fully contracted may provide some valve actuation. Kruger does not, however, disclose that the lost motion system may be designed such as to provide limp home capability. Kruger rather discloses a lost motion system which starts from a fully contracted position upon every cycle of the engine. The lost motion system thereby provides a base level of valve actuation when fully contracted, such base level being modifiable only after the lost motion system has been displaced a predetermined distance. It follows therefore that the Kruger lost motion system is undesirably limited to starting from a fully contracted position each engine cycle and cannot vary the amount of lost motion until after the lost motion system has been displaced by a cam motion.

Many lost motion systems have also typically not utilized high speed mechanisms to rapidly vary the length of the lost motion system. Lost motion systems have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

Applicant has determined that the lost motion system and method of the present invention may be particularly useful in engines requiring valve actuation for positive power, compression release engine braking, and exhaust gas recirculation valve events. Typically, compression release and exhaust gas recirculation events involve much less valve lift than do positive power related valve events. Compression release and exhaust gas recirculation events may, however, require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, Applicant has determined that it may be beneficial to have a lost motion system which is capable of providing control over positive power, compression release, and exhaust gas recirculation events, and which will provide only positive power or some low level of compression release and exhaust gas recirculation valve events, should the lost motion system fail.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

Previous lost motion systems or method, routinely have not enabled precise control of valve actuation to optimize valve movement for different engine operating conditions, while maintaining an acceptable limp home capability. Furthermore, the lost motion systems or methods of that are known do not teach or suggest the use of a high speed lost motion system capable of varying the amount of lost motion during a valve event such that the system independently controls valve opening and closing times, while maintaining an acceptable limp home capability. Such independent control may be realized by modifying a standard cam lobe initiated valve opening event with precise amounts of lost motion, which may range between a minimum and maximum amount at different times during the valve event. In addition, none of the prior art discloses, teaches or suggests any system or method for defaulting to a predetermined level of positive power valve actuation (which may or may not include some exhaust gas recirculation) should control of a lost motion system be lost.

Accordingly, there is a significant need for a system and method of controlling lost motion which: (i) optimizes engine operation under various engine operating conditions; (ii) provides precise control of lost motion; (iii) provides acceptable limp home capability; and (iv) provides for high speed variation of the length of a lost motion system.

Known systems for providing lost motion valve actuation have also tended to be nonintegrated devices which add considerable bulk to the valve train. As vehicle dimension have decreased, so have engine compartment sizes. Accordingly, there is a need for a less bulky lost motion system, and in particular for a system which is compact and has a relatively low profile.

Furthermore, there is a need for low profile lost motion systems capable of varying valve actuation responsive engine and ambient conditions. Variable actuation of intake and exhaust valves in an internal combustion engine may be useful for all of the aforementioned valve events (positive power and engine braking). When the engine is in positive power mode, variation of the opening and closing times of intake and exhaust valves may be used to modify valve opening and closing times in an attempt to optimize fuel efficiency, power, exhaust cleanliness, exhaust noise, etc., for particular engine and ambient conditions. During engine braking, variable valve actuation may enhance braking power and decrease engine stress and noise by modifying valve actuation as a function of engine and ambient conditions.

OBJECTS OF THE INVENTION

It is therefore an object of the present invention to provide a system and method for optimizing engine operation under various engine and ambient operating conditions by valve actuation control.

It is another object to of the present invention to provide a system and method for providing high speed control of the lost motion in a valve train.

It is another object of the present invention to provide a system and method for controlling the amount of lost motion provided by a lost motion system.

It is a further object of the present invention to provide a system and method of valve actuation which provides a limp home capability.

It is yet another object of the present invention to provide a system and method for selectively actuating a valve with a lost motion system for positive power, compression release braking, and exhaust gas recirculation modes of operation.

It is still a further object of the invention to provide a system and method for valve actuation which is compact and light weight.

SUMMARY OF THE INVENTION

In response to this challenge, Applicants have developed an innovative and reliable engine valve actuation system comprising: a pivoting bridge including (1) means for contacting an adjustable tappet, (2) means for contacting a valve stem, and (3) a pivot point; an adjustable tappet in contact with the means for contacting the adjustable tappet; and means for providing valve actuation motion, said motion means being in contact with said pivot point.

Applicants have also developed an innovative and reliable method of actuating an engine valve comprising the steps of: determining a desired level of valve actuation; adjusting the position of an adjustable tappet responsive to the desired level of valve actuation; and applying a fixed valve actuation motion to a pivoting bridge, said pivoting bridge including a first contact point in contact with the adjustable tappet, and a second contact point in contact said engine valve, wherein the position of said adjustable tappet determines the amount of fixed valve actuation motion that is transmitted by said pivoting bridge to said engine valve.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE PREFERRED EMBODIMENTS

Figure 1:
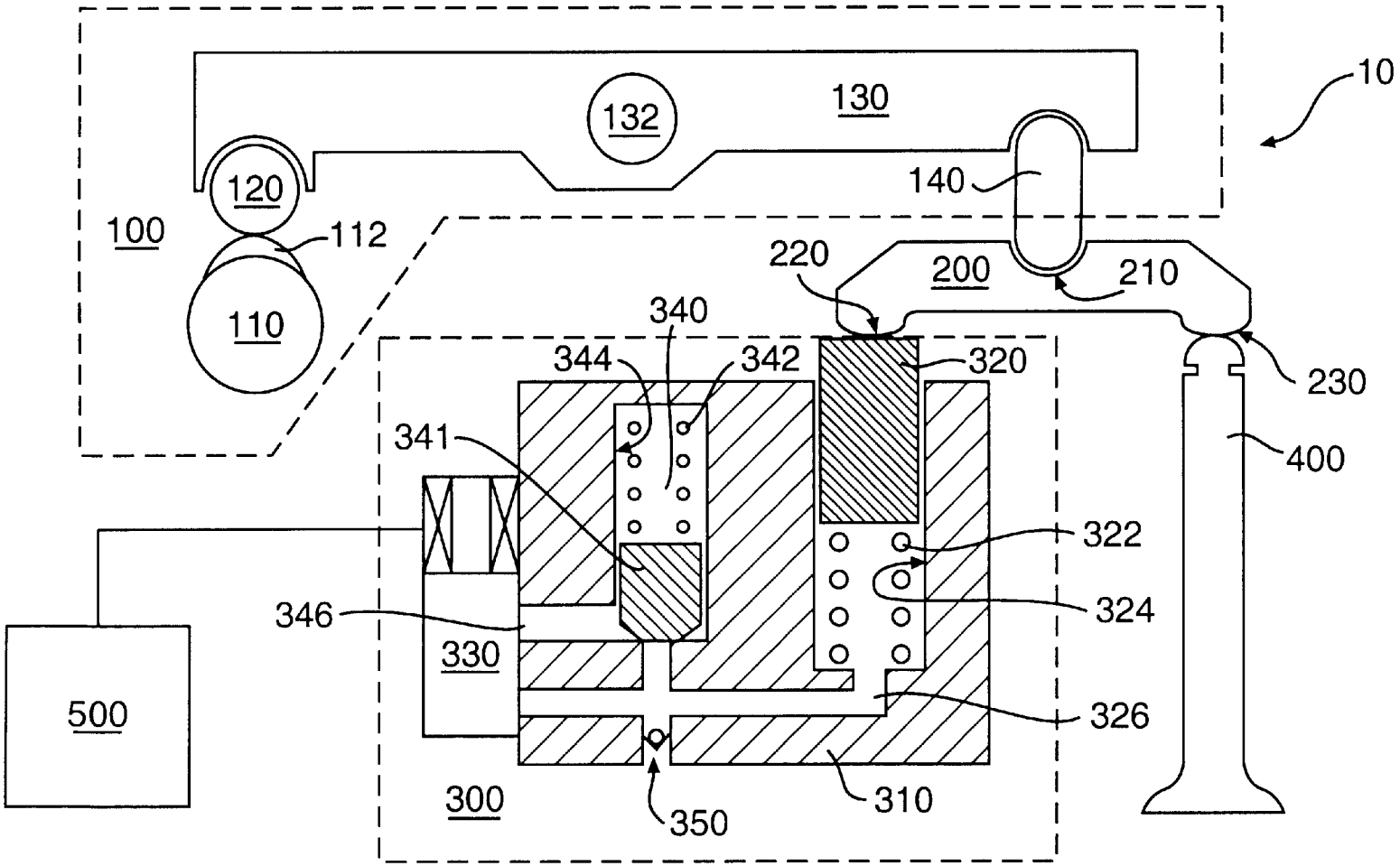
FIG. 1 is a cross-section in elevation of a valve actuator embodiment of the invention.

Reference will now be made in detail to a preferred embodiment of the present invention, an example of which is illustrated in the accompanying drawings. A preferred embodiment of the present invention is shown in FIG. 1 as an engine valve actuation system 10.

Engine valve actuation system 10 may include a means for providing valve actuation motion 100. The motion means 100 may include various valve train elements, such as a cam 110, a cam roller 120, a rocker arm 130, and a lever pushrod 140. A fixed valve actuation motion may be provided to the motion means 100 via one or more lobes 112 on the cam 110. Displacement of the roller 120 by the cam lobe 112 may cause the rocker arm 130 to pivot about an axle 132. Pivoting of the rocker arm 130 may, in turn, cause the lever pushrod 140 to be displaced linearly. The particular arrangement of elements that comprise the motion means 100 may not be critical to the invention. For example, cam 110 alone could provide the linear displacement provided by the combination of cam 110, roller 120, rocker arm 130, and lever pushrod 140, in FIG. 1.

Motion means 100 may contact a pivoting bridge 200 at a pivot point 210 (which may or may not be recessed in the bridge). The position of the surface 220 may be adjusted by adjusting the position of the surface on which the surface 220 rests. The pivoting bridge 200 may also include a surface 220 for contacting an adjustable tappet 320, and a surface 230 for contacting a valve stem 400. Valve springs (not shown) may bias the valve stem 400 upward and cause the surface 220 to be biased downward against a system 300 for providing a moveable surface.

System 300 may include a housing 310, a tappet 320, a trigger valve 330, and an accumulator 340. The housing 310 may include multiple passages therein for the transfer of hydraulic fluid through the system 300. A first passage 326 in the housing 310 may connect the bore 324 with the trigger valve 330. A second passage 346 may connect the trigger valve 330 with the accumulator 340. A third passage 348 may connect the accumulator 340 with a check valve 350.

The tappet 320 may be slidably disposed in a tappet bore 324 and biased upward against the surface 220 by a tappet spring 322. The biasing force provided by the tappet spring 322 may be sufficient to hold the tappet 320 against the surface 220, but not sufficient to resist the downward displacement of the tappet when a significant downward force is applied to the tappet by the surface 220.

The accumulator 340 may include an accumulator tappet 341 slidably disposed in an accumulator bore 344 and biased downward by an accumulator spring 342. Hydraulic fluid that passes through the trigger valve 330 may be stored in the accumulator 340 until it is reused to fill bore 324.

Linear displacement may be provided by the motion means 100 to the pivoting bridge 200. Displacement provided to the pivoting bridge 200 may be transmitted through surface 230 to the valve stem 400. The valve actuation motion that is transmitted by the pivoting bridge 200 to the valve stem 400 may be controlled by controlling the position of the surface 220 relative to the pivot point 210. Given the input of a fixed downward motion on the pivoting bridge 200 by the pushrod 140, if the position of the surface 220 is raised relative to the pivot point 210, then the downward motion experienced by the valve stem 400 is increased relative to what it would have otherwise been. Conversely, if the position of the surface 220 is lowered relative to the pivot point 210, then the downward motion experienced by the valve stem 400 is decreased. Thus, by selectively lowering the position of the surface 220, relative to the pivot point 210, motion imparted by the motion means 100 to the pivoting bridge 200 may be selectively "lost".

When the motion means 100 applies a downward displacement to the pivoting bridge 200, the displacement experienced by the valve stem 400 may be controlled by controlling the position of tappet 320 at the time of such downward displacement. During such downward displacement, tappet 320 pressurizes the hydraulic fluid in bore 324 beneath the tappet. The hydraulic pressure is transferred by the fluid through passage 326 to the trigger valve 330. Thus, selective bleeding of hydraulic fluid through the trigger valve 330 may enable control over the position of the tappet 320 the bore 324 by controlling the volume of hydraulic fluid in the bore underneath the tappet.

It may be desirable to use a trigger valve 330 that is a high speed device; i.e. a device that is capable of being opened and closed more than once during an engine cycle. The trigger valve 330 may, for example, be similar to the trigger valves disclosed in the Sturman U.S. Pat. No. 5,460,329 (issued Oct. 24, 1995), for a High Speed Fuel Injector; and/or the Gibson U.S. Pat. No. 5,479,901 (issued Jan. 2, 1996) for a Electro-Hydraulic Spool Control Valve Assembly Adapted For A Fuel Injector. The trigger valve 330 may include a passage connecting first passage 326 and second passage 346, a solenoid, and a passage blocking member responsive to the solenoid. The amount of hydraulic fluid in the bore 324 may be controlled by selectively blocking and unblocking the passage in the trigger valve 330. Unblocking the passage through the trigger valve 330 enables hydraulic fluid in the bore 324 and the first passage 326 to be transferred to the accumulator 340.

An electronic controller 500 may be used to control the position of the solenoid in the trigger valve 330. By controlling the time at which the passage through the trigger valve is open, the controller 500 may control the amount of hydraulic fluid in the bore 324, and thus control the position of the tappet 320.

With regard to a method embodiment of the invention, the system 300 may operate as follows to control valve actuation. The system 300 may be initially charged with oil, or some other hydraulic fluid, through a check valve 350. Trigger valve 330 may be kept open at this time to allow oil to fill passages 348,346, and 326, and to fill bore 324. Once the system is charged, the controller 500 may close the trigger valve 330, thereby locking the tappet 320 into a relatively fixed position based on the volume of oil in the bore 324. Thereafter, the controller 500 may determine a desired level of valve actuation and determine the required position of the tappet 320 to achieve this level of valve actuation. The controller 500 may then selectively open the trigger valve 330 to allow the correct amount of oil to escape from the bore 324 such that the tappet 320 is lowered into the proper position to provide the desired level of valve actuation. The motion means 100 may then apply a fixed displacement motion to the pivoting bridge 200, while the pivoting bridge is supported on one end by the tappet 320. The tappet 320 may be raised later by reopening the trigger valve 330 after the motion means 100 has completed its downward displacement motion.

The system 300 may be designed to provide limp home capability should the system develop a hydraulic fluid leak. Limp home capability may be provided by having a tappet 320, tappet spring 322, and bore 324 of a particular design. The combined design of these elements may be such that they provide a tappet position which will still permit main exhaust valve actuation when the bore 324 is completely devoid of hydraulic fluid. These elements may alternatively be designed to provide both main exhaust, and a low level of compression release braking when the bore 324 is devoid of hydraulic fluid. The system 300 may provide limited lost motion, and thus limp home capability, in three ways. Contact between the tappet 320 and the end of the bore 324 may limit lost motion; contact between the accumulator tappet 341 and the accumulator bore 344 may limit lost motion; and contact between the pivoting bridge surface 220 and the housing 310 may limit lost motion. Limiting lost motion through contact between the pivoting bridge surface 220 and the housing 310 may be facilitated by making surface 220 wider than the bore 324 so that the outer edges of the surface 220 may engage the housing 310.

Figure 2:
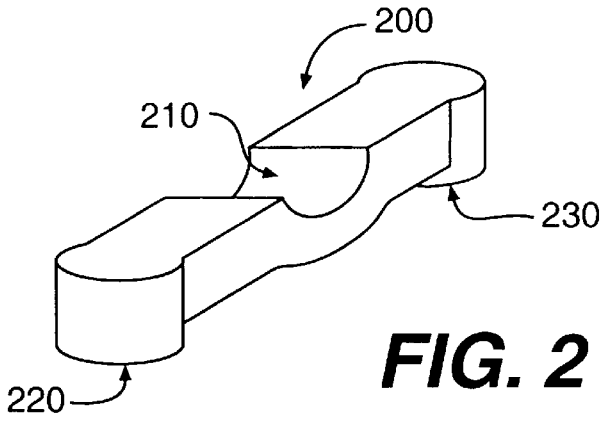
FIG. 2 is a pictorial illustration of a pivoting bridge element of the present invention.
Figure 3:
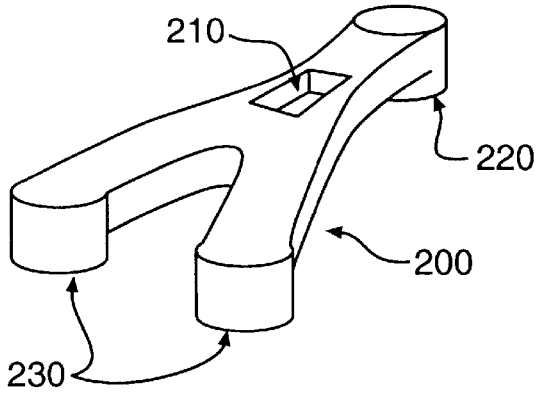
FIG. 3 is a pictorial illustration of an alternative pivoting bridge element of the present invention.
Figure 5:
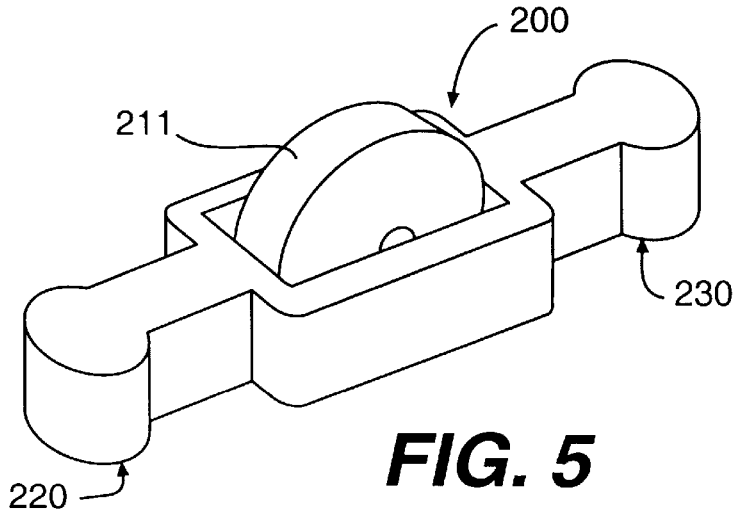
FIG. 5 is a pictorial illustration of an alternative pivoting bridge element of the present invention.

Alternative designs for the pivoting bridge 200, which fall within the scope of the invention, are shown in FIGS. 2, 3 and 5. The pivoting bridge 200 shown in FIG. 3 is a y-shaped yoke that includes two surfaces 230 for contacting two different valve stems (not shown). The pivoting bridge 200 shown in FIG. 5 includes a roller 211 for direct contact with a cam.

In alternative embodiments of the invention, the trigger valve 330 need not be a solenoid activated trigger, but could instead be hydraulically or mechanically activated. No matter how it is implemented, the trigger valve 330 preferably may be capable of providing one or more opening and closing movements per cycle of the engine and/or one or more opening and closing movements during an individual valve event.

Figure 4:
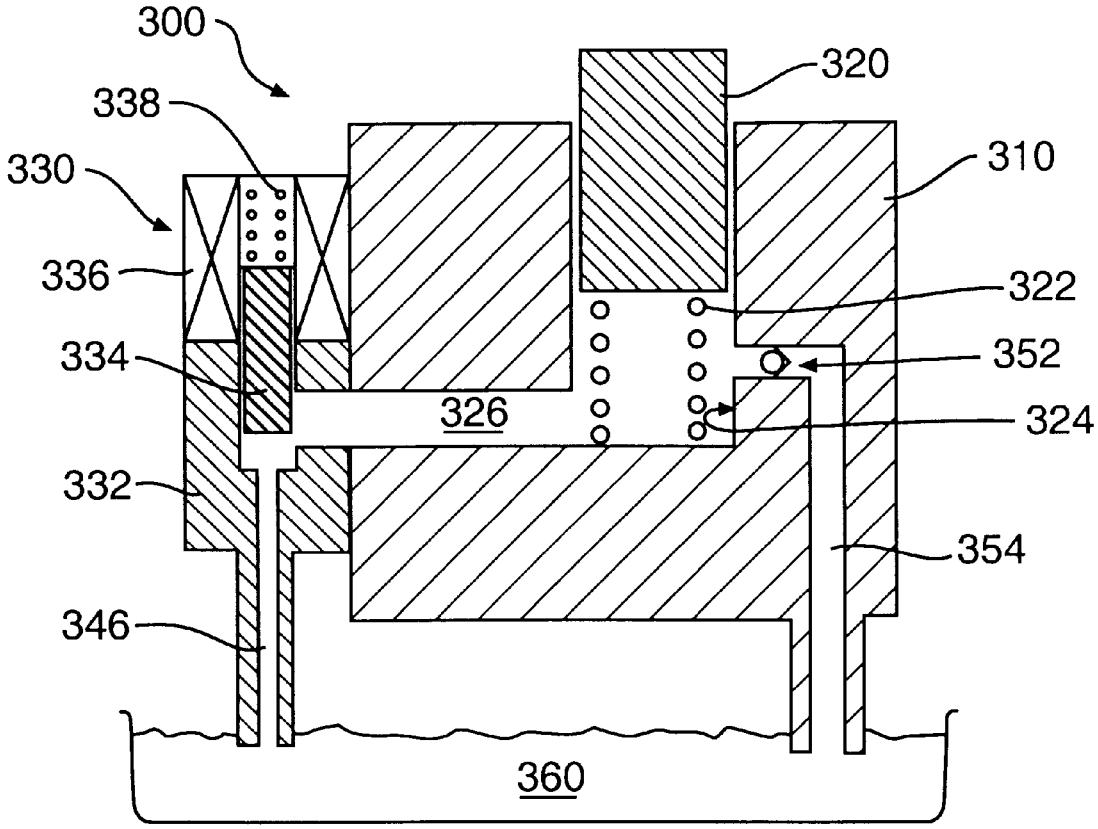
FIG. 4 is a cross-section in elevation of an alternative valve actuator embodiment of the invention.

An alternative embodiment of the system 300 of FIG. 1 is shown in FIG. 4, in which like reference numerals refer to like elements. With reference to FIG. 4, the tappet 320 may be slidably provided in a bore 324, and biased upward by a tappet spring 322. The bore 324 may be charged with hydraulic fluid provided through a fill passage 354 from a fluid source 360. Hydraulic fluid may be prevented from flowing back out of the bore 324 into the fill passage 354 by a check valve 352.

Hydraulic fluid in the bore 324 may be selectively released back to the fluid source 360 through a trigger valve 330. The trigger valve 330 may communicate with the bore 324 via a first passage 326. The trigger valve 330 may include a trigger housing 332, a trigger plunger 334, a solenoid 336, and a plunger return spring 338. Selective actuation of the solenoid 336 may result in opening and closing the plunger 334. When the plunger 334 is open, hydraulic fluid may escape from the bore 324 and flow back through the trigger valve and passage 346 to the fluid source 360. The selective release of fluid from the bore 324 may result in selective lowering of the position of the tappet 320. When the plunger 334 is closed, the volume of hydraulic fluid in the bore 324 is locked, which may result in maintenance of the position of the tappet 320, even as pressure is applied to the tappet from above.

It will be apparent to those skilled in the art that variations and modifications of the present invention can be made without departing from the scope or spirit of the invention. For example, the shape and size of the pivoting bridge may be varied, as well as the relative locations of the surface for contacting the tappet, the surface for contacting the valve stem, and the pivot point. Furthermore, it is contemplated that the scope of the invention may extend to variations in the design and speed of the trigger valve used, and in the engine conditions that may bear on control determinations made by the controller. The invention also is not limited to use with a particular type of valve train (cams, rocker arms, push tubes, etc.). It is further contemplated that any hydraulic fluid may be used in the invention. Thus, it is intended that the present invention cover all modifications and variations of the invention, provided they come within the scope of the appended claims and their equivalents.

We claim:

1. An engine valve actuation system comprising:

a pivoting bridge including (1) means for contacting an adjustable tappet at a first end of said bridge, (2) means for contacting a valve stem at a second end of said bridge, and (3) a pivot point;

an adjustable tappet spring biased into contact with the means for contacting the adjustable tappet;

means for providing valve actuation motions, said motion means being in contact with said pivot point; and means for adjusting the position of the adjustable tappet, wherein said adjusting means comprises a trigger valve in hydraulic communication with the adjustable tappet and a trigger valve controller.

2. The engine valve actuation system of claim 1 wherein the adjustable tappet is mounted in a housing, and wherein the trigger valve is mounted on said housing.

3. The engine valve actuation system of claim 1 wherein the trigger valve is adapted to provide at least one opening and closing movement per cycle of the engine.

4. The engine valve actuation system of claim 1 wherein the trigger valve provides selective hydraulic communication between the adjustable tappet and an accumulator.

5. The engine valve actuation system of claim 1 wherein the trigger valve provides selective hydraulic communication between the adjustable tappet and a hydraulic fluid source.

6. The engine valve actuation system of claim 1 wherein the adjustable tappet comprises a cylindrical member that is spring biased into contact with said pivoting bridge.

7. The engine valve actuation system of claim 1 wherein said pivot point is approximately equidistant from said means for contacting the adjustable tappet and said means for contacting the valve stem.

8. The engine valve actuation system of claim 1 wherein said pivot point is closer to said means for contacting the adjustable tappet than said means for contacting the valve stem.

9. The engine valve actuation system of claim 1 wherein said pivot point is closer to said means for contacting the valve stem than said means for contacting the adjustable tappet.

10. The engine valve actuation system of claim 1 wherein said pivoting bridge comprises means for contacting two valve stems.

11. The engine valve actuation system of claim 1 wherein the means for contacting the adjustable tappet is adapted to contact a housing for the adjustable tappet such that an amount of lost motion provided by the system is limited.

12. The engine valve actuation system of claim 1 wherein the adjustable tappet is slidably disposed in a bore, said adjustable tappet being adapted to contact an end of the bore such that an amount of lost motion provided by the system is limited.

13. An engine valve actuation system comprising:

a pivoting bridge including (1) a first end for contacting an adjustable tappet, (2) a second end for contacting a valve stem, and (3) a pivot point between the first and second ends;

an adjustable tappet in contact with the first end;

a valve stem in contact with the second end;

a valve train element in contact with the pivot point;

a trigger valve;

means for providing hydraulic communication between the trigger valve and the adjustable tappet; and means for controlling the operation of the trigger valve to adjust the position of the adjustable tappet, wherein the means for providing hydraulic communication between the trigger valve and the adjustable tappet further comprises an accumulator tappet slidably disposed in an accumulator bore, said accumulator tappet being adapted to contact an end of the accumulator bore such that an amount of lost motion provided by the system is limited.

14. The engine valve actuation system of claim 13 wherein the means for controlling the operation of tile trigger valve is adapted to adjust the position of the adjustable tappet at least one time per cycle of an engine in which the system is provided.

15. The engine valve actuation system of claim 13 wherein said pivot point is approximately equidistant from said first end and said second end.

16. The engine valve actuation system of claim 15 wherein the adjustable tappet comprises a cylindrical member and a spring biasing the cylindrical member into contact with said pivoting bridge.

17. The engine valve actuation system of claim 13 wherein said pivot point is closer to said first end than said second end.

18. The engine valve actuation system of claim 17 wherein the adjustable tappet comprises a cylindrical member and a spring biasing the cylindrical member into contact with said pivoting bridge.

19. The engine valve actuation system of claim 13 wherein said pivot point is closer to said second end than said first end.

20. The engine valve actuation system of claim 19 wherein the adjustable tappet comprises a cylindrical member and a spring biasing the cylindrical member into contact with said pivoting bridge.

21. The engine valve actuation system of claim 13 wherein said pivoting bridge comprises means for contacting two valve stems.

* * * * *

UNITED STATES PATENT AND TRADEMARK OFFICE

CERTIFICATE OF CORRECTION

PATENT NO. : 6,085,705

DATED : July 11, 2000

INVENTOR(S) : Joseph M. Vorih

It is certified that error appears in the above-identified patent and that said Letters Patent is hereby corrected as shown below:

In the drawings, Sheet 1, Fig. 1 is corrected to appear as follows so that the first passage 326 does not directly communicate with passage 348:

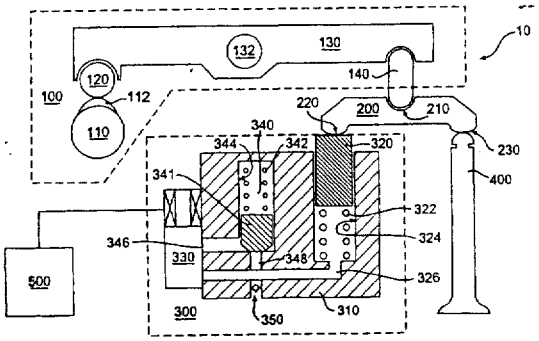

*FIG. 1*

Signed and Sealed this

Twenty-second Day of May, 2001

*Attest:*

Nicholas P. Godici

NICHOLAS P. GODICI

*Attesting Officer*

*Acting Director of the United States Patent and Trademark Office*